US008006672B2

(12) United States Patent
Krenus et al.

(10) Patent No.: US 8,006,672 B2
(45) Date of Patent: Aug. 30, 2011

(54) METHOD FOR COLD STARTING OF ETHANOL-FUELED ENGINES

(75) Inventors: Roberto G. Krenus, Sao Paulo (BR); Frans M. M. Theunissen, Sao Paulo (BR)

(73) Assignee: Delphi Technologies, Inc., Troy, MI (US)

( * ) Notice: Subject to any disclaimer, the term of this patent is extended or adjusted under 35 U.S.C. 154(b) by 355 days.

(21) Appl. No.: 12/266,928

(22) Filed: Nov. 7, 2008

(65) Prior Publication Data

US 2009/0120396 A1 May 14, 2009

(30) Foreign Application Priority Data

Nov. 8, 2007 (BR) ..... 0705394

(51) Int. Cl.
*F02D 41/06* (2006.01)

(52) U.S. Cl. ..... 123/492; 123/406.53; 123/543; 123/179.5; 123/179.16; 701/113

(58) Field of Classification Search ..... 123/179.16, 123/179.21, 492, 543, 544, 1 A, 198 A, 431, 123/406.53, 179.5; 701/103–105, 113
See application file for complete search history.

(56) References Cited

U.S. PATENT DOCUMENTS

| | | | | |
|---|---|---|---|---|
| 4,212,163 | A * | 7/1980 | Mikina | 60/39.63 |
| 5,179,923 | A * | 1/1993 | Tsurutani et al. | 123/435 |
| 5,664,540 | A * | 9/1997 | Matsuoka et al. | 123/254 |
| 6,915,776 | B2 * | 7/2005 | zur Loye et al. | 123/304 |
| 6,997,156 | B2 * | 2/2006 | Tanei et al. | 123/179.3 |

FOREIGN PATENT DOCUMENTS

JP 61-294125 * 12/1986

* cited by examiner

*Primary Examiner* — Hai H Huynh
(74) *Attorney, Agent, or Firm* — Thomas N. Twomey

(57) ABSTRACT

A method for starting an internal combustion engine under cold conditions. The intake manifold throttle valve is held closed and spark ignition is suspended. Fuel and air are admitted into the cylinders and the pistons are cranked for a plurality of revolutions. During each engine revolution cycle, the fuel/air mixture is compressed and heated adiabatically by the energy of the engine starter motor, and the mixture is exhausted into the exhaust manifold. During valve overlap a portion of the mixture is withdrawn into the cylinder and recompressed in the next cycle. Additional fuel may be injected to replace lost fuel. After several engine cycles, the fuel/air mixture becomes heated to a temperature above the flashpoint of the mixture. Sparking is re-established to fire the warmed mixture, and the intake throttle valve is re-enabled. The first firing can provide sufficient heat to continue spark-firing of newly-introduced mixture thereafter.

18 Claims, 6 Drawing Sheets

METHOD FOR COLD STARTING OF ETHANOL-FUELED ENGINES

TECHNICAL FIELD

The present invention relates to methods and apparatus for starting internal combustion engines; more particularly, to such methods for starting engines fueled in part or in whole by high flashpoint fuels at low ambient temperatures; and most particularly, to a method for cold-starting of an engine fueled by a high flashpoint fuel.

BACKGROUND OF THE INVENTION

Fuel-injected internal combustion engines fueled in part or in whole by high flashpoint fuels, such as alcohols (ethanol, methanol, and the like) are well known. As used herein, the term "alcohol" is taken to mean all such forms of alcohol fuels and alcohol/alkane blends. Further, the flashpoint of a fuel is defined as the lowest temperature at which the fuel can form an ignitable mixture with air. At or below this temperature, fuel vapor may cease to burn when the source of ignition is removed.

A known problem with fueling internal combustion engines with alcohol fuels is a relatively high fuel flash point as compared to octane or other alkane fuels, making starting under cold conditions difficult or impossible. For example, ethanol has a flash point of about 12° C., meaning that ethanol vapor at that temperature may cease to burn when a source of ignition is removed. The practical result in the prior art is that, for vehicles and engines to be operated on alcohol in relatively cold climates, some enhancement of the fuel supply system is required to ensure that the engine can be started at temperatures below about 18° C., depending upon the percentage of alcohol in the alkane fuel supplied to the engine.

In engines fueled fully by alcohol and which must be operated in a cold environment, it is known to provide a small reservoir of gasoline and a system for injecting small amounts of gasoline into the engine in order to start it and to bring the engine temperature above the alcohol flash point. Such a device, although effective, can be undesirable for adding cost to the manufacture of an engine and vehicle and for requiring gasoline for operation, however brief.

U.S. Pat. No. 5,119,794 to Kushida et al. discloses a positive temperature coefficient (PTC) resistance heater block mounted on an inner wall of a gas passage such as an engine intake manifold or manifold runner. The heater block has branched fuel passages through which a liquid fuel is supplied and then vaporized by the heat of the heater so as to inject vaporized fuel from the openings of respective passages in the heater block. This vaporized fuel gas is joined to a liquid fuel gas injected by a fuel injector. Therefore, even if the fuel applied contains alcohol, the heater can efficiently heat the fuel without being influenced by the heat of vaporization of the alcohol so as to assist the atomization of the fuel.

Disadvantages of this prior art are that it is useful in only manifold-injected engines and not port-injected engines, since it is downstream of the fuel injector; its presence in the manifold can cause an air flow restriction; and it adds a further component, and therefore expense and complexity, to an engine.

U.S. Pat. No. 5,361,990 to Pimental discloses a PTC heater assembly applied to the extended tip of a fuel injector within an engine firing chamber. A plurality of self-regulating electrical resistance heater elements are secured to the outer surface of the fuel injector tip in sequence extending around the nozzle tip, and means are connected to the elements for connecting the elements to a power source for energizing the heaters to heat the fuel injector tip to heat the fuel just before it enters the firing chamber.

Two disadvantages of this prior art are that it requires an elongated fuel injector tip extending relatively far into the firing chamber, in comparison to standard prior art tips, which can create problems in positioning and actions of valves and the piston in the firing chamber and can adversely affect the fuel discharge pattern of the injector; and it requires that the heating elements, which are electrical components, be exposed to the extreme thermal, pressure, and percussive environment of a firing chamber.

U.S. Pat. No. 5,609,297 to Gladigow et al. discloses an atomization device that is fitted or attached directly onto a nozzle tip of a fuel injector. Fuel to be atomized flows longitudinally through the device in direct contact with vaporizer baffles and electrically-powered PTC heating elements and is discharged therefrom into the firing chamber.

Some disadvantages of this invention are that, as in the just-discussed invention, the device extends relatively far into the firing chamber, in comparison to standard prior art tips. Its stated purpose is to vaporize gasoline for cold start emissions reduction, not to alleviate an alcohol cold-start problem by warming the alcohol without vaporization. Further, it is an auxiliary fuel atomizer and thus adds to the size, cost, and complexity of a fuel injector.

Still further, the PTC electrical components are in full contact with fuel, which during steady state engine operation is a hot and potentially corrosive environment. As noted in U.S. Pat. No. 5,758,826, direct exposure of the PTC material and the electrical connections to the fuel supply can possibly cause fouling of the surfaces, degrading the performance of the unit and/or loss of the electrical connection.

Still further, the patent purports that the device does not alter the injection spray pattern, but this cannot be so, because the spray pattern of a fuel injector is controlled by a director plate within the valve of the fuel injector, and the director plate of a fuel injector equipped with this device is masked by the device.

U.S. Pat. No. 5,758,826 to Nines discloses an internal heater for a fuel injector barrel including an array of plates of PTC material arranged about the valve element in a square tube shape, and surrounded by a heat insulating polytetrafluroethylene sleeve. The plates are preferably coated with polyimide to be protected from the fuel which flows over both surfaces of the plates. Electrical connections are established by inner and outer bands attached to the plates, with a conductive disc having tabs extending to the bands. Spring-loaded contact pins located radially outward from a seal on the side have wires extending to the connector body contacts of the injector.

Disadvantages of this invention are that it includes spring-loaded pins, seals, coating, insulators, adhesives and other materials in contact with fuel in a hot, wet, and potentially corrosive environment. The limited space available within the injector tip severely limits the amount of power that can be brought to bear in heating the fuel. The fuel injector is significantly more complex and therefore more difficult and expensive to manufacture than a comparable unit having an external heater, such as is disclosed in U.S. Pat. No. 5,361,990, discussed above.

What is needed in the art is a simple method for starting an internal combustion engine under cold ambient conditions wherein alcohol-based or other high flashpoint fuels may be heated reliably, economically, safely, and efficiently to suitable temperatures above their flashpoints.

It is a principal object of the present invention to assure reliable starting of an internal combustion engine when fueled with a high flashpoint fuel when ambient temperatures are below the flashpoint of the fuel.

SUMMARY OF THE INVENTION

Briefly described, in a simple system and method for starting an internal combustion engine under cold conditions, the intake manifold intake valve is held closed to prevent admission of further air to the engine, and spark ignition is suspended. Fuel is injected into the cylinders and the pistons are then cranked conventionally for one or more engine revolutions, preferably a plurality of revolutions. During each complete engine revolution cycle, the fuel and air in the cylinder is compressed and heated adiabatically by the cranking energy of the engine starter motor. The heated fuel/air mixture is exhausted into the exhaust manifold, but during the intake/exhaust valve overlap period, a portion of the heated mixture is sucked back into the cylinder and recompressed on the next compression stroke. Additional fuel may be injected as needed to replace the fuel lost to the exhaust system on the previous cycle. After a predetermined number of engine cycles, the fuel/air mixture is heated by repeated compressions to a temperature well above the flashpoint of the mixture. Conventional sparking is re-established and the heated mixture is fired, and the intake throttle valve is re-enabled. The first firing can provide sufficient heat to the cylinder to continue spark-firing of newly-introduced mixture thereafter. The present invention also includes a computer program product arranged for causing a processor in an Electronic Control Module (ECM) to execute the method describe above.

BRIEF DESCRIPTION OF THE DRAWINGS

The present invention will now be described, by way of example, with reference to the accompanying drawings, in which FIGS. 1 through 5 are schematic cross-sectional views of an internal combustion engine showing sequential stages of the present method in a four-stroke engine cycle, wherein:

FIG. 1 shows the engine at the beginning of the compression stroke;

FIG. 2 shows the engine at the top of the compression stroke;

FIG. 3 shows the engine at the start of the exhaust stroke;

FIG. 4 shows the engine at the top of the exhaust stroke and the beginning of the intake stroke;

FIG. 5 shows the engine part way down the intake stroke; and

The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
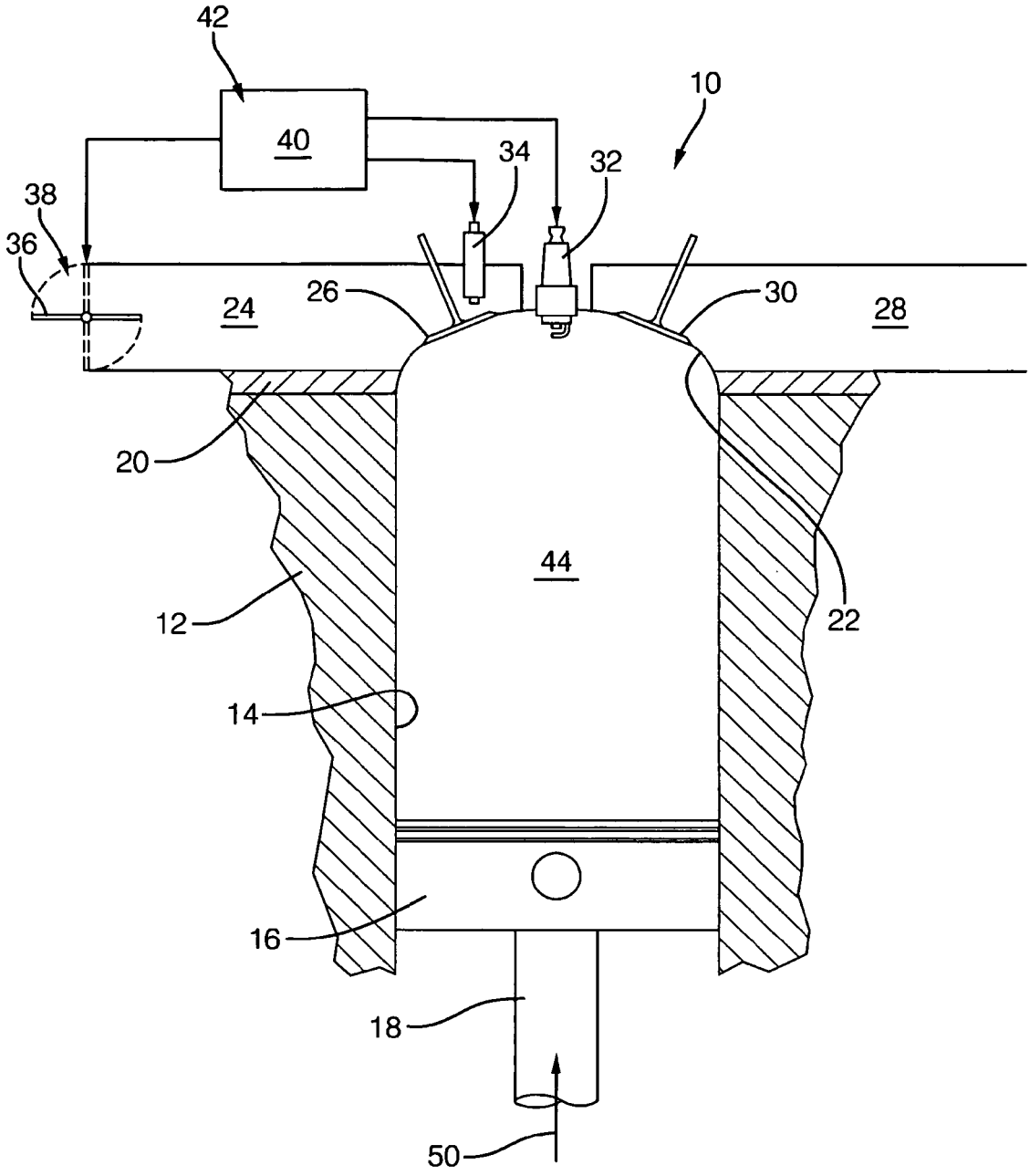

Referring to FIG. 1, a conventional spark-ignited internal combustion engine 10 in accordance with the invention comprises an engine block 12 containing a compression cylinder 14; a piston 16 and connecting rod 18 slidably disposed within cylinder 14 and connected to a crankshaft (not shown) for reciprocating motion of piston 16 within cylinder 14; an engine head 20 mounted on block 12 and having a domed firing chamber 22 formed therein in mating relationship with cylinder 14; an intake manifold 24 formed in head 20 and communicating with firing chamber 22 via an intake valve 26; an exhaust manifold 28 formed in head 20 and communicating with firing chamber 22 via an exhaust valve 30; a spark plug 32 disposed in firing chamber 22 for igniting a fuel/air mixture therein; a port fuel injector 34 disposed in intake manifold 24 adjacent intake valve 26; a throttle valve 36 defining an air entrance port 38 to intake manifold 24; and an Engine Control Module (ECM) 40 in controlling relationship with spark plug 32, fuel injector 34, and throttle valve 36. ECM 40 includes a processor and a memory, wherein the processor is able to execute instructions for performing the method in accordance with the present invention. Note that fuel injector 34 may alternatively be a direct injector as is well known in the engine art for injecting fuel directly into firing chamber 22 to create mixture 44 rather than into the port of manifold 24 as shown in FIG. 1.

The engine structure thus described is well known in the prior engine art. The present invention is directed to a system and method for controlling these engine components via an algorithm or computer program product 42 stored in the memory of ECM 40 in the form of instructions that may be executed to form a fuel/air mixture 44 within cylinder 14 and firing chamber 22, and to heat mixture 44 by repeated adiabatic compressions during successive engine cycles, as described below, which raise the temperature of mixture 44 above its flashpoint, after which mixture 44 can be ignited during a subsequent engine cycle by firing of spark plug 32 to cause engine 10 to start.

These components are common to all of FIGS. 1 through 5 and need not be repeated for each of the figures except as they relate to each illustrated stage of a method in accordance with the invention.

Referring now to FIGS. 1 through 5, a series of engine cycle stages will now be described, illustrative of a system and method in accordance with the invention for starting an internal combustion engine when the ambient starting temperature is below the flash point of the initial fuel/air mixture of a high flashpoint fuel such as ethanol.

Referring first to FIG. 1, engine 10 is shown at the beginning of a compression stroke, the crankshaft (not shown) being driven conventionally by an electric starting motor (not shown). In accordance with a system and method of the present invention, throttle valve 36 is disabled by ECM 40, with the throttle valve closed so that manifold 24 is a closed chamber. Further, the normal spark timing of spark plug 32 is suspended. Intake and exhaust valves 26,30 are conventionally closed. An air/fuel mixture 44 within cylinder 14 has been created previously by injection of fuel from injector 34 into manifold 24 while throttle 36 and intake valve 26 were open. The temperature of air/fuel mixture 44 is below the flashpoint thereof such that engine 10 cannot be started by attempted ignition thereof through sparking by spark plug 32. It will be seen that as piston 16 is advanced in direction 50, the temperature of mixture 44 will be increased by adiabatic compression. Because the cylinder firing chamber walls are also colder than the mixture flashpoint, heat is also lost to these walls such that the net temperature increase of mixture 44 is insufficient to make the mixture combustible. This, of course, is the basic problem in the prior art which is overcome by a method of the invention.

Figure 2:
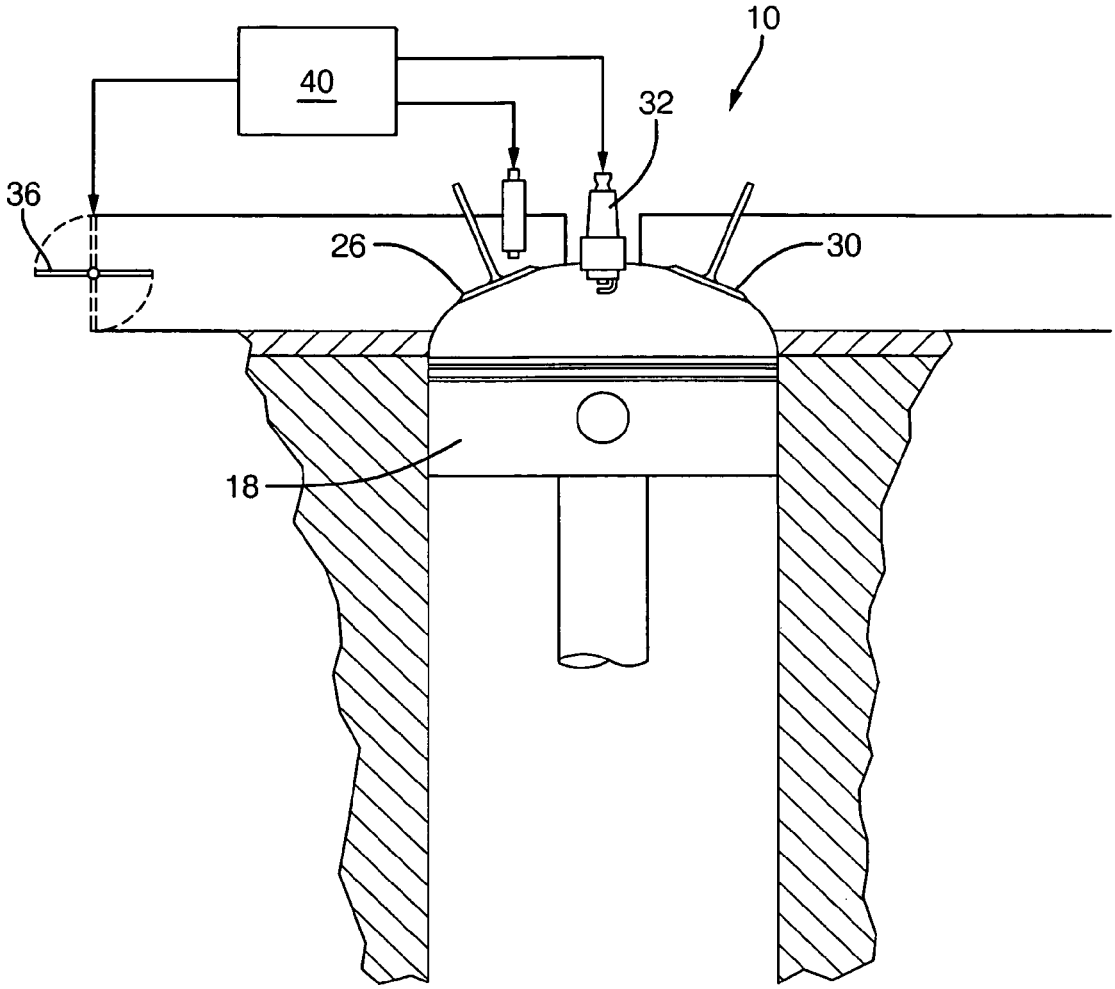

Referring next to FIG. 2, at the top of the compression stroke, mixture 44 is fully compressed and at an adiabatically-induced temperature maximum that is still insufficient for combustion to occur. Sparking is still suspended, and throttle 36 and valves 26,30 remain closed.

Figure 3:
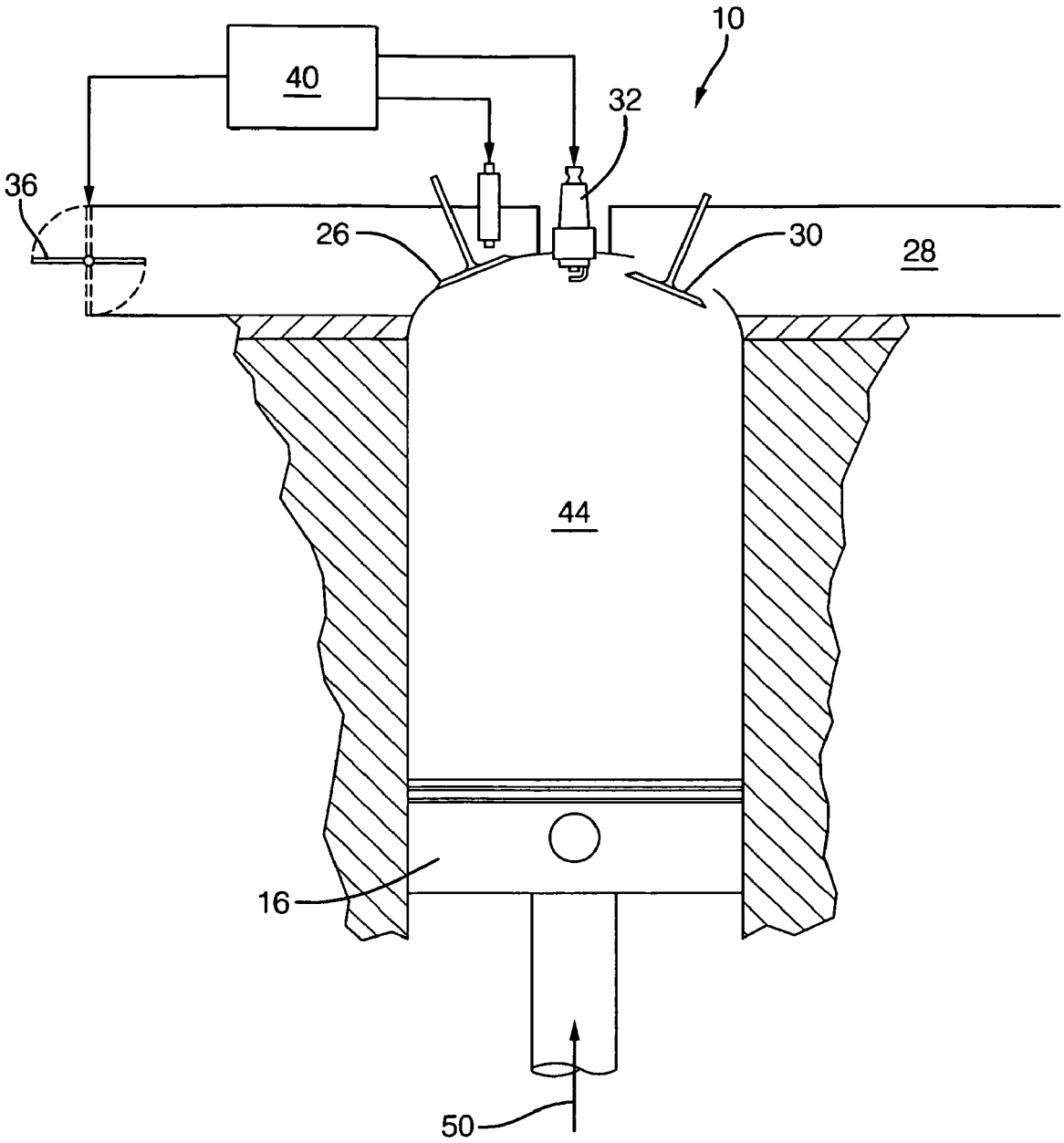

Referring next to FIG. 3, the "power" stroke of engine 10 has been completed and piston 16 is at bottom dead center and mixture 44 has been adiabatically expanded. Although no net work has been performed on mixture 44 between FIGS. 1 and 3, a net transfer of energy has occurred from the starter motor via the compressed mixture into the thermal mass of the cylinder and firing chamber walls through cranking of the crankshaft, and thus the temperature of mixture 44 is incrementally raised over the beginning temperature of the mixture in FIG. 1. In FIG. 3, exhaust valve 30 is opened in preparation for exhausting mixture 44 into exhaust manifold 28 by motion of piston 16 in direction 50.

Figure 4:
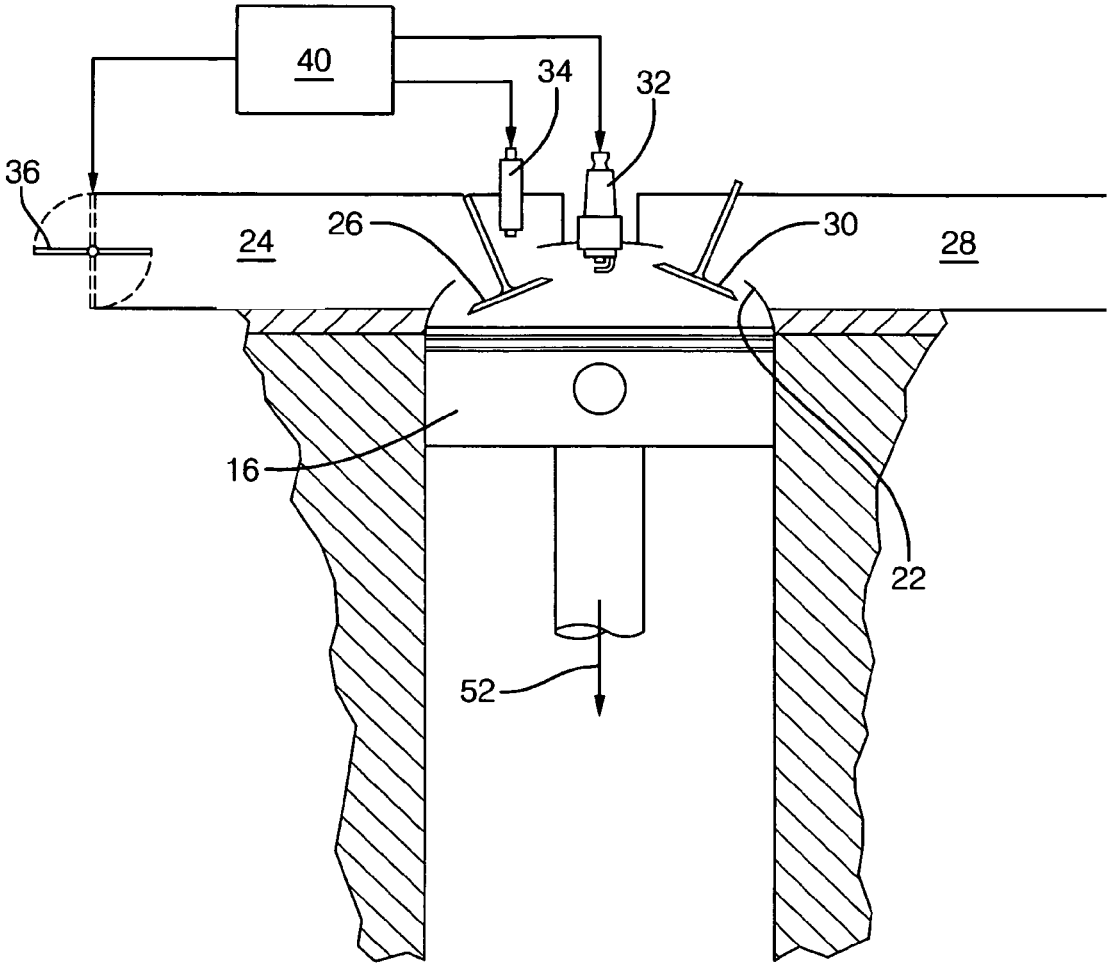

Referring next to FIG. 4, at the top of the exhaust stroke of piston 16, exhaust valve 30 is still open, and mixture 44 has been largely displaced into exhaust manifold 28 except for the tidal volume of firing chamber 22. The intake stroke is beginning by motion of piston 16 in reciprocal direction 52. Intake valve 26 opens, but little air charge from manifold 24 is drawn into cylinder 14 because throttle valve 36 is still disabled and closed. Exhaust valve 30 is also typically still open during the first part of the intake stroke because under normal engine operating conditions it is desirable to return into the cylinder a predetermined amount of exhaust gas (exhaust gas recirculation, or EGR) as is well known in the engine art for dilution of a new mixture 44 to lower combustion temperatures and thus reduce formation of NOx and SOx compounds. In the present invention, this arrangement allows a portion of the previously warmed but not combusted mixture 44 to be returned from exhaust manifold 28 instead of new mixture from intake manifold 24.

Figure 5:
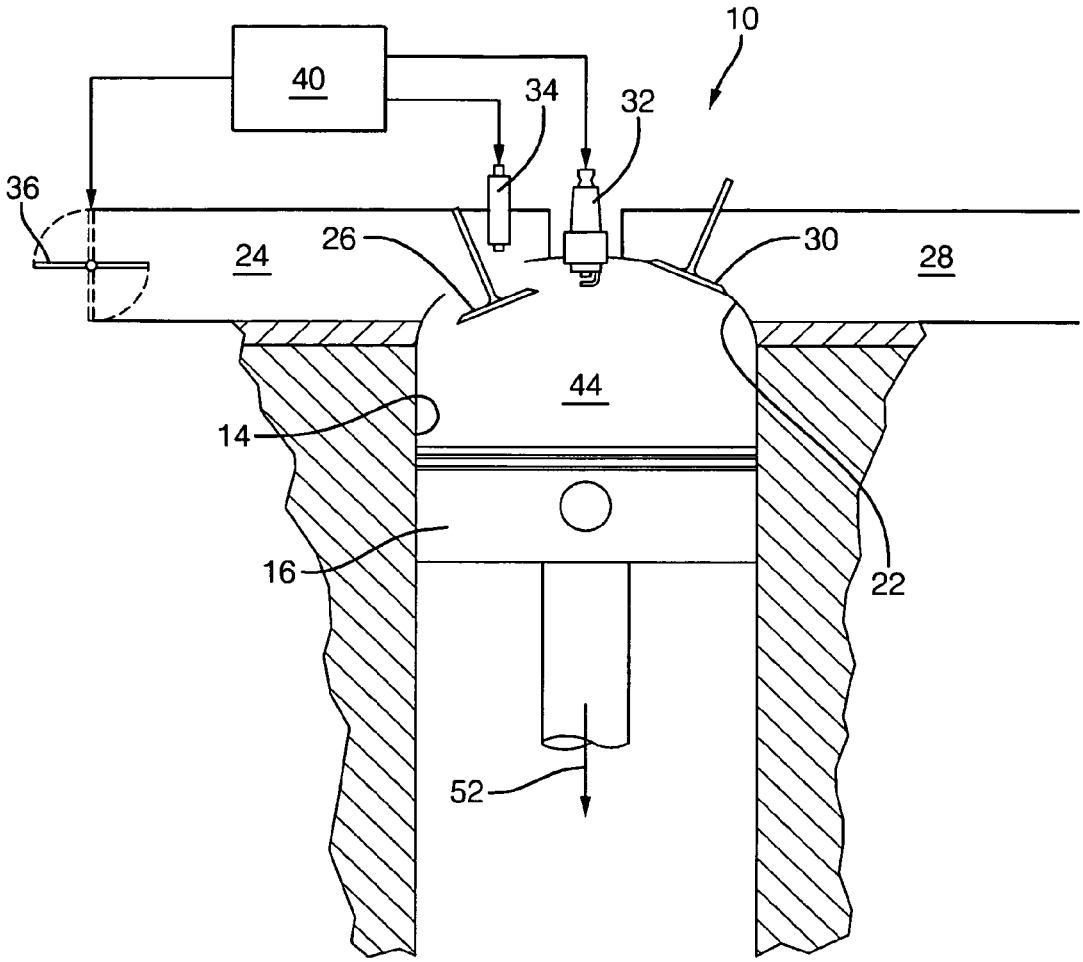

Referring now to FIG. 5, after exhaust valve 30 is closed, the intake stroke of piston 16 continues in direction 52, creating a partial vacuum within cylinder 14 and drawing some air at reduced pressure from manifold 24 via open intake valve 26. Additional fuel may be injected by fuel injector 34 to replace the fuel lost previously into exhaust manifold 28. Fuel preferably is injected in a plurality of discrete pulses separated by time intervals, for example, 2 msec on and 2 msec off. The reduced pressure within cylinder 14 assists in vaporizing the additional fuel. At the bottom of the intake stroke, intake valve 26 is closed, completing the four strokes of an engine cycle and returning the engine to the beginning of a second compression stroke identical with that shown in FIG. 1. At this point, the net effects of the first engine cycle are that the temperatures of the walls of cylinder 14 and firing chamber 22 and mixture 44 have been raised incrementally over their respective beginning temperatures.

It will be seen that repeating additional engine cycles will serve eventually to raise the temperature of mixture 44 at the end of a compression stroke to a temperature above the flashpoint thereof sufficient to support combustion. At this point, the regular timing of spark plug 32 and fuel injector 34 is re-established, and also conventional control of throttle valve 36. Mixture 44 is then fired to start engine 10.

Figure 6:
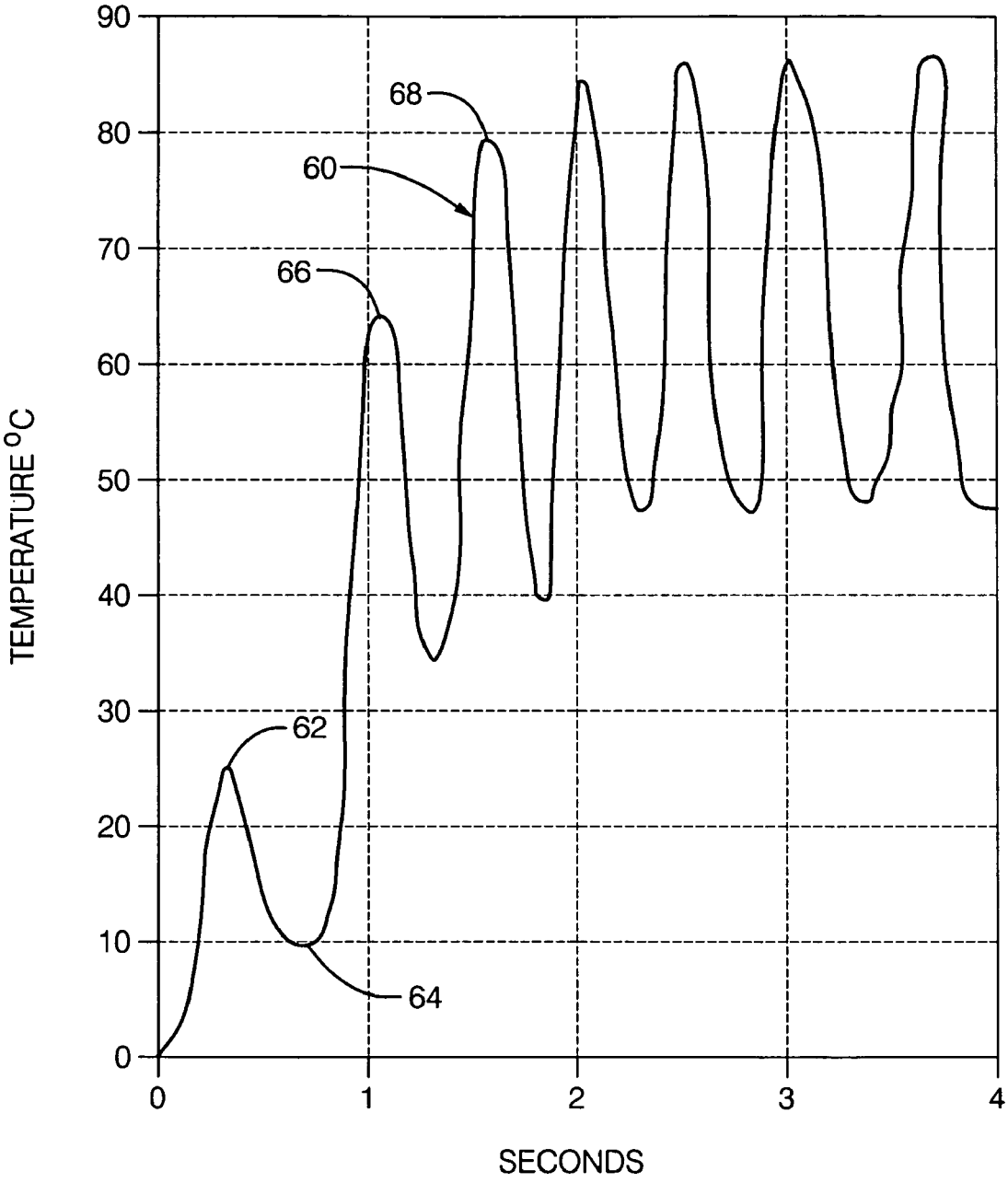
FIG. 6 shows a graph of an exemplary progressive temperature buildup in a fuel/air mixture during progress of successive engine cycles of an individual cylinder in accordance with the present invention.

Referring now to FIG. 6, curve 60 shows an exemplary progressive temperature buildup in mixture 44 during progress of successive engine cycles of an individual cylinder in accordance with the present invention. Beginning at a mixture temperature of 0° C., the first compression (FIGS. 1 and 2) raises the in-cylinder temperature to about 25° C. (point 62). The temperature falls back to about 10° C. (point 64) during the subsequent mixture expansion (FIGS. 4 and 5), but then is raised to about 65° C. (point 66) in the second compression, and to about 80° C. (point 68) in the third compression. The temperature cycles reach an 85/47° C. equilibrium. In the present case, spark ignition would be instituted at the top of the third compression cycle. Thus, the engine would be startable after 2½ cycles, requiring less than two seconds.

The number of cycles required is a function of the flashpoint of the fuel being provided and the ambient temperatures of the fuel and within the engine, which temperatures may be determined by conventional sensors and provided to ECM 40. Typically, the first successful firing of mixture 44 will serve to raise the internal engine temperature to a level at which further conventional operation may be maintained. If not, the method the invention may be repeated.

Once engine 10 begins firing, the position of intake throttle valve 36 must be carefully controlled to increase engine speed to idle RPM while maintaining the lowest possible intake manifold pressure to assist in vaporizing fuel.

The crank angle at which fuel injection begins and ends can affect the success of the present method. In general, fuel should be delivered with an open intake valve to avoid buildup of fuel film on the walls of cylinder 14, as such fuel film can reduce beneficial heat transfer from the walls. However, and preferably, it is desirable to inject some fuel into intake manifold 24 ahead of opening of intake valve 26, which opening occurs just before the top of the exhaust stroke shown in FIG. 3. This allows a small reverse pressure pulse from the firing chamber into the intake manifold to partially fill the manifold with fuel droplets, thus premixing and partially vaporizing the fuel ahead of its being draw into the firing chamber and cylinder as described above prior to beginning the engine cycles in accordance with the present method.

The disclosed starting system and method of the present invention can also be useful in starting engines under temperature conditions wherein ambient temperatures of fuel and engine are substantially above the flashpoint of a fuel/air mixture, and even for lower flashpoint fuels containing little or no ethanol. Use of the present system and method for starting can result in lower emissions of unburned hydrocarbons than can the conventional method of firing the mixture on the first engine cycle.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for starting a spark-ignited internal combustion engine having a piston reciprocally disposed in a combustion cylinder capped by a firing chamber in an engine head; the engine further including an intake air manifold having an entrance throttle valve and being in communication with said firing chamber via an intake valve; the engine further including an exhaust manifold in communication with said firing chamber via an exhaust valve; the engine further including a spark igniter disposed in said firing chamber and a fuel injector disposed in either of said intake manifold or said firing chamber, characterized in that the method comprises the steps of:

a) forming a mixture of fuel and air within said firing chamber and cylinder;

b) holding said entrance throttle valve closed, and disabling said spark igniter and said fuel injector;

c) cranking said engine through at least one complete four-stroke engine cycle to adiabatically heat said mixture of fuel and air;

d) re-enabling normal controlled operation of said entrance throttle valve, said spark igniter, and said fuel injector to ignite said adiabatically heated mixture of fuel and air and thereby start said engine.

2. A method in accordance with claim 1 wherein said cranking step is repeated a plurality of times before said re-enabling step.

3. A method in accordance with claim 1 wherein said fuel has a flashpoint above the ambient temperature of said engine at the start of said method.

4. A method in accordance with claim 1 wherein said fuel includes an alcohol.

5. A method in accordance with claim 4 wherein said alcohol is ethanol.

6. A method in accordance with claim 1 wherein said cranking step further comprises the steps of:

a) compressing said mixture in an engine compression stroke;

b) expanding said mixture in an engine power stroke;

c) passing a portion of said mixture through said exhaust valve into said exhaust manifold in an engine exhaust stroke; and d) passing a part of said portion of said mixture back into said cylinder and firing chamber through said exhaust valve in an engine intake stroke.

7. A method in accordance with claim 1 wherein said engine is a multi-cylinder engine and wherein said method is performed for each of said cylinders.

8. A method in accordance with claim 1 wherein said step of cranking said engine through at least one complete four-stroke engine cycle increases the temperature of at least one of said combustion cylinder and said firing chamber.

9. A computer program product arranged for causing a processor of a control module to execute the method of claim 1.

10. A system for starting a spark-ignited internal combustion engine, said system comprising:

a combustion cylinder capped by a firing chamber in an engine head;

a piston reciprocally disposed in said combustion cylinder;

an intake air manifold having an entrance throttle valve and being in communication with said firing chamber via an intake valve;

an exhaust manifold in communication with said firing chamber via an exhaust valve;

a spark igniter disposed in said firing chamber;

a fuel injector disposed in either of said intake manifold or said firing chamber; and a control module including a processor and a memory, said processor operable to execute a method characterized by the steps of:

a) forming a mixture of fuel and air within said firing chamber and cylinder;

b) holding said entrance throttle valve closed, and disabling said spark igniter and said fuel injector;

c) cranking said engine through at least one complete four-stroke engine cycle to adiabatically heat said mixture of fuel and air; and d) re-enabling normal controlled operation of said entrance throttle valve, said spark igniter, and said fuel injector to ignite said adiabatically heated mixture of fuel and air and thereby start said engine.

11. A system in accordance with claim 10 wherein said cranking step is repeated a plurality of times before said re-enabling step.

12. A system in accordance with claim 10 wherein said fuel has a flashpoint above the ambient temperature of said engine at the start of said method.

13. A system in accordance with claim 12 wherein said alcohol is ethanol.

14. A system in accordance with claim 10 wherein said fuel includes an alcohol.

15. A system in accordance with claim 10 wherein said cranking step further comprises the steps of:

a) compressing said mixture in an engine compression stroke;

b) expanding said mixture in an engine power stroke;

c) passing a portion of said mixture through said exhaust valve into said exhaust manifold in an engine exhaust stroke; and d) passing a part of said portion of said mixture back into said cylinder and firing chamber through said exhaust valve in an engine intake stroke.

16. A system in accordance with claim 10 wherein said engine is a multi-cylinder engine and wherein said method is performed for each of said cylinders.

17. A system in accordance with claim 10 wherein said step of cranking said engine through at least one complete four-stroke engine cycle increases the temperature of at least one of said combustion cylinder and said firing chamber.

18. A method for starting a spark-ignited internal combustion engine having a piston reciprocally disposed in a combustion cylinder capped by a firing chamber in an engine head; the engine further including an intake air manifold having an entrance throttle valve and being in communication with said firing chamber via an intake valve; the engine further including an exhaust manifold in communication with said firing chamber via an exhaust valve; the engine further including a spark igniter disposed in said firing chamber and a fuel injector disposed in one of said intake manifold and said firing chamber, characterized in that the method comprises the steps of:

using said fuel injector to form a mixture of fuel and air within said firing chamber and said cylinder;

cranking said engine through at least one complete four-stroke engine cycle to adiabatically heat said mixture of fuel and air;

holding said entrance throttle valve closed through said at least one complete four-stroke cycle;

disabling said spark igniter and said fuel injector through said at least one complete four-stroke cycle;

re-enabling normal controlled operation of said entrance throttle valve, said spark igniter, and said fuel injector to ignite said adiabatically heated mixture of fuel and air and thereby start said engine.

* * * * *